US006604732B1

(12) United States Patent
Brinker

(10) Patent No.: US 6,604,732 B1
(45) Date of Patent: Aug. 12, 2003

(54) AIRPLANE CRASH BARRIER

(75) Inventor: David G. Brinker, Metamora, IL (US)

(73) Assignee: ROHN Industries, Inc., Peoria, IL (US)

( * ) Notice: Subject to any disclaimer, the term of this patent is extended or adjusted under 35 U.S.C. 154(b) by 0 days.

(21) Appl. No.: 10/176,094

(22) Filed: Jun. 20, 2002

(51) Int. Cl.[7] ..... E04H 17/00

(52) U.S. Cl. ..... 256/1; 256/23; 244/110 R; 244/110 C; 244/110 F

(58) Field of Search ..... 404/6; 256/1, 13.1, 256/23; 244/110 R, 11 C, 110 F; 52/651.01, 721.4, 724.5

(56) References Cited

U.S. PATENT DOCUMENTS

| | | | | | |
|---|---|---|---|---|---|
| 2,354,754 | A | | 8/1944 | Irwin | |
| 2,365,778 | A | | 12/1944 | Schwab | |
| 2,374,261 | A | | 4/1945 | Ames | |
| 2,435,197 | A | * | 2/1948 | Brodie | 244/110 F |
| 2,465,936 | A | * | 3/1949 | Schultz | 244/110 R |
| 2,675,197 | A | * | 4/1954 | Hospers | 244/110 R |
| 2,913,197 | A | * | 11/1959 | Fonden et al. | 244/110 R |
| 2,974,760 | A | | 3/1961 | Woolslayer et al. | |
| 3,353,795 | A | * | 11/1967 | Muller | 256/13.1 |
| 3,383,076 | A | | 5/1968 | Van Zelm et al. | |
| 3,468,500 | A | | 9/1969 | Carlsson | |
| 3,468,515 | A | * | 9/1969 | Lamb | 256/1 |
| 4,295,317 | A | | 10/1981 | Van Tielen | |
| 4,768,417 | A | | 9/1988 | Wright | |
| 4,809,933 | A | | 3/1989 | Buzby et al. | |
| 4,819,915 | A | | 4/1989 | Cargnel | |
| 4,973,199 | A | | 11/1990 | Cox | |
| 5,054,717 | A | * | 10/1991 | Taylor | 244/110 F |
| 5,115,997 | A | | 5/1992 | Peterson | |
| 5,536,117 | A | | 7/1996 | Frame et al. | |
| 5,583,311 | A | | 12/1996 | Rieger | |
| 6,099,200 | A | | 8/2000 | Pepe et al. | |
| 6,123,294 | A | * | 9/2000 | Genovese | 244/110 C |

* cited by examiner

*Primary Examiner*—Gary S. Hartmann
(74) *Attorney, Agent, or Firm*—Wood, Phillips, Katz, Clark & Mortimer

(57) ABSTRACT

A barrier, which is intended to intercept a crashing airplane before it reaches a target, comprises an array of spaced towers. Each tower is several hundred feet tall. Each tower comprises a trusswork including three steel tubes, which are filled with a cementitious material, such as grout, in a triangular array wherein one tube is closer to the target. Guys interconnect the towers to one another and to ground anchors. Each tube comprises plural sections having end flanges, at which those sections are bolted to one another, and gaskets to prevent the cementitious material, as it is being pumped, from being extruded between the flanges before it has cured.

6 Claims, 4 Drawing Sheets

AIRPLANE CRASH BARRIER

TECHNICAL FIELD OF THE INVENTION

This invention pertains to a barrier, which is intended to intercept a crashing airplane before it reaches a target. The barrier comprises an array of spaced towers, each of which is several hundred feet tall, and further comprises guys interconnecting each tower with another tower, with ground anchors, or with both.

BACKGROUND OF THE INVENTION

Recent attacks on the World Trade Center in New York, N.Y., and on the Pentagon have heightened concerns that power plants, chemical plants, and other similar and dissimilar targets might be highly vulnerable to airplanes that could crash into such targets, either accidentally or deliberately. A concept has been suggested, by another or others, that a barrier comprised of spaced poles, pylons, or towers, if constructed and situated properly, might intercept a crashing airplane before it reached a target.

SUMMARY OF THE INVENTION

This invention improves on the aforenoted concept that a barrier comprised of spaced poles, pylons, or towers, if constructed and situated properly, might intercept a crashing airplane before it reached a target. This invention can be suitably embodied in a barrier wherein each tower is several hundred feet tall.

According to a first aspect of this invention, the barrier further comprises a first set of guys interconnecting each tower of the array with at least one other tower of the array, whereby forces imparted by an airplane crashing into a given tower of the array are distributed by guys of the first set to the tower or towers interconnected with the given tower. According to a second aspect of this invention, the barrier further comprises a second set of guys extending away from the target, extending downwardly, and connecting the towers to ground anchors, whereby forces imparted by an airplane crashing into a given tower of the array are distributed by guys of the second set to the ground anchors connected to given tower. The first and second aspects of this invention can be advantageously combined.

Preferably, each tower comprises a trusswork, which includes steel tubes. Preferably, each tube is filled at least partially with a cementitious material, such as grout, which is pumped into said tube and which is allowed to cure. Preferably, each tube comprises plural sections, which have end flanges and which are bolted to one another at the flanges. Preferably, the flanges contacted by the cementitious material being pumped have means, which may comprise gaskets, to prevent the cementitious material from being extruded between the flanges contacted by the cementitious material before the cementitious material has cured.

BRIEF DESCRIPTION OF THE DRAWINGS

In FIG. 2, the towers are illustrated as interconnected by guys to one another and to other towers, which are not illustrated in FIG. 2, in a manner contemplated by this invention.

In FIG. 3, the tower is illustrated as interconnected by guys to ground anchors, in a manner contemplated by this invention.

DETAILED DESCRIPTION OF THE ILLUSTRATED EMBODIMENT

Figure 1:
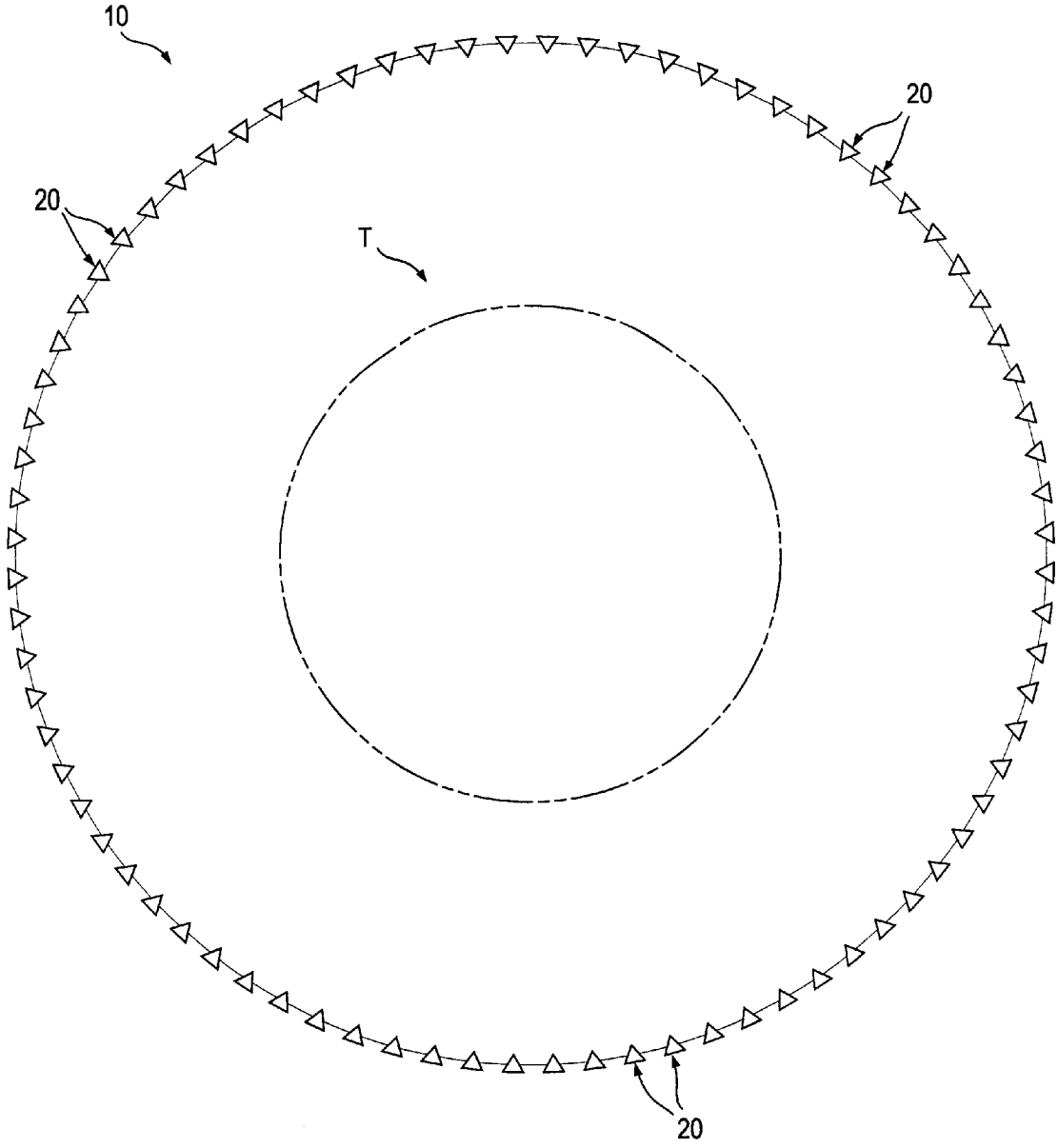
FIG. 1 is a schematic plan of an endless array of similar towers, as contemplated by this invention. So as to simplify the schematic plan, guys discussed below are not illustrated in FIG. 1.

As illustrated in FIG. 1, a barrier 10, which is intended to intercept a crashing airplane before the crashing airplane reaches a target T, such as a power plant or a chemical plant, comprises numerous similar towers 20, which are arrayed in an endless array around the target T. In an alternative arrangement, which is not illustrated, the towers 20 are arrayed in a linear or sinuous array, which is spaced from such a target.

Figure 2:
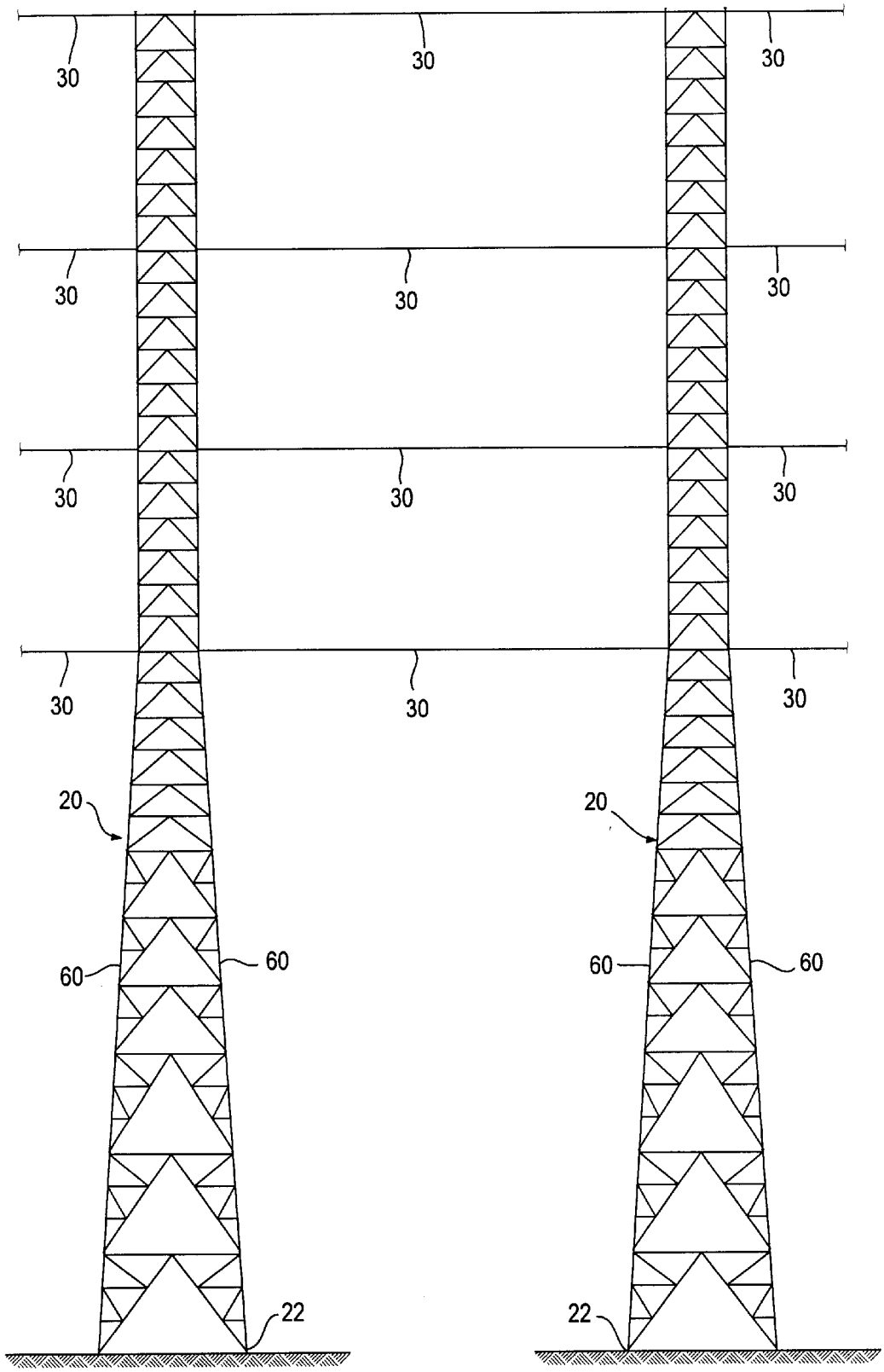
FIG. 2, on a larger scale compared to FIG. 1, is a schematic elevation of two towers of the endless array, as viewed from outside the endless array.

As illustrated in FIG. 2, the barrier 10 further comprises a first set of heavy-duty guys 30 interconnecting each tower 20 of the endless array with the towers 20 on opposite sides of said tower 20, whereby forces imparted by an airplane crashing into a given tower 20 of the endless array are distributed by guys 30 of the first set to other towers 20 interconnected with the given tower 20.

Figure 3:
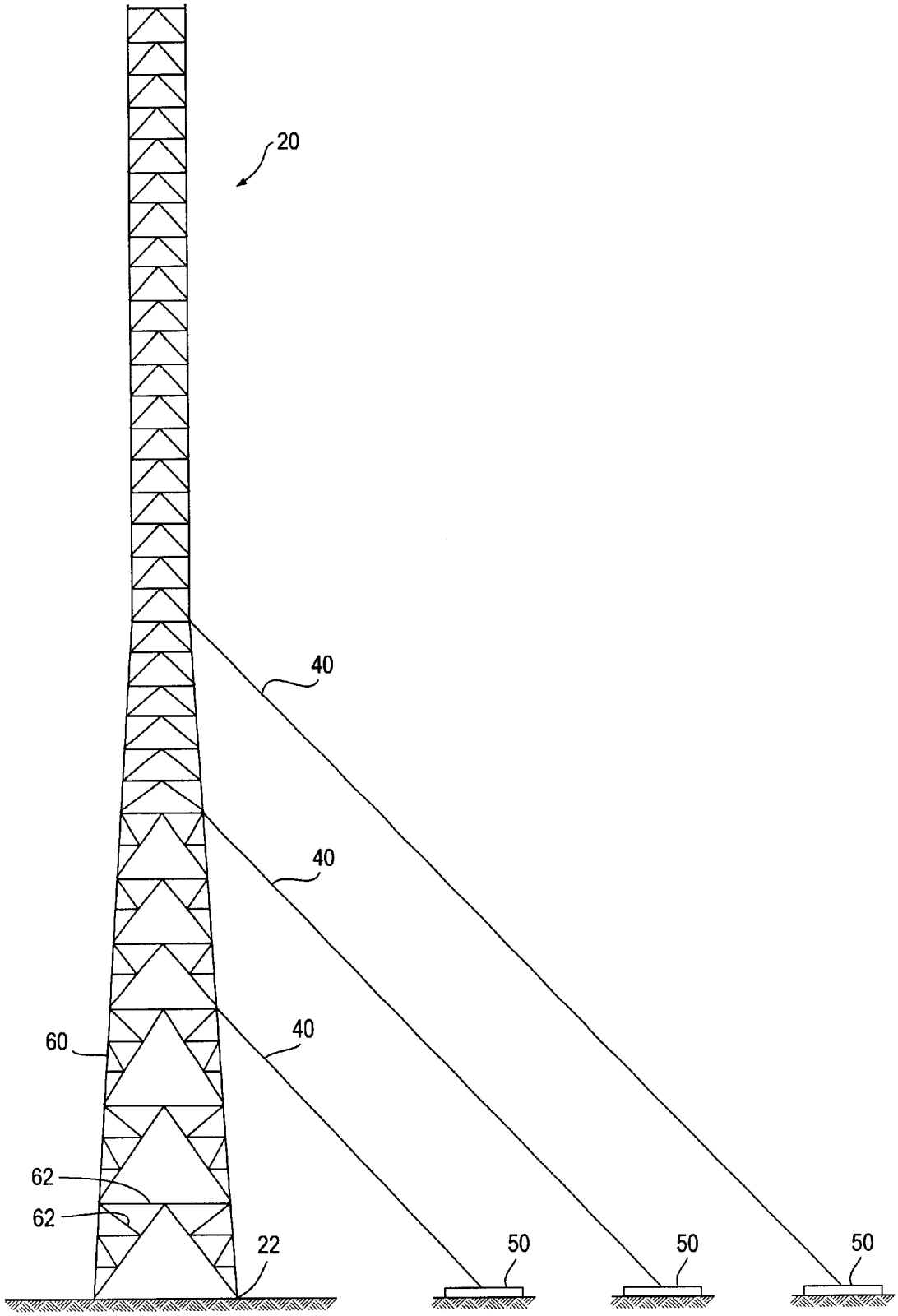
FIG. 3, on a similar scale, is a schematic elevation of one tower of the endless array, as viewed from one side of the tower.

As illustrated in FIG. 3, the barrier 10 further comprises a second set of heavy-duty guys 40 extending away from the target T, extending downwardly, and connecting the towers 20 of the endless array to ground anchors 50, which are used conventionally in tower construction, whereby forces imparted by an airplane crashing into a given tower 20 of the array are distributed by guys 40 of the second set to the ground anchors 50 connected to the given tower 20.

Figure 4:
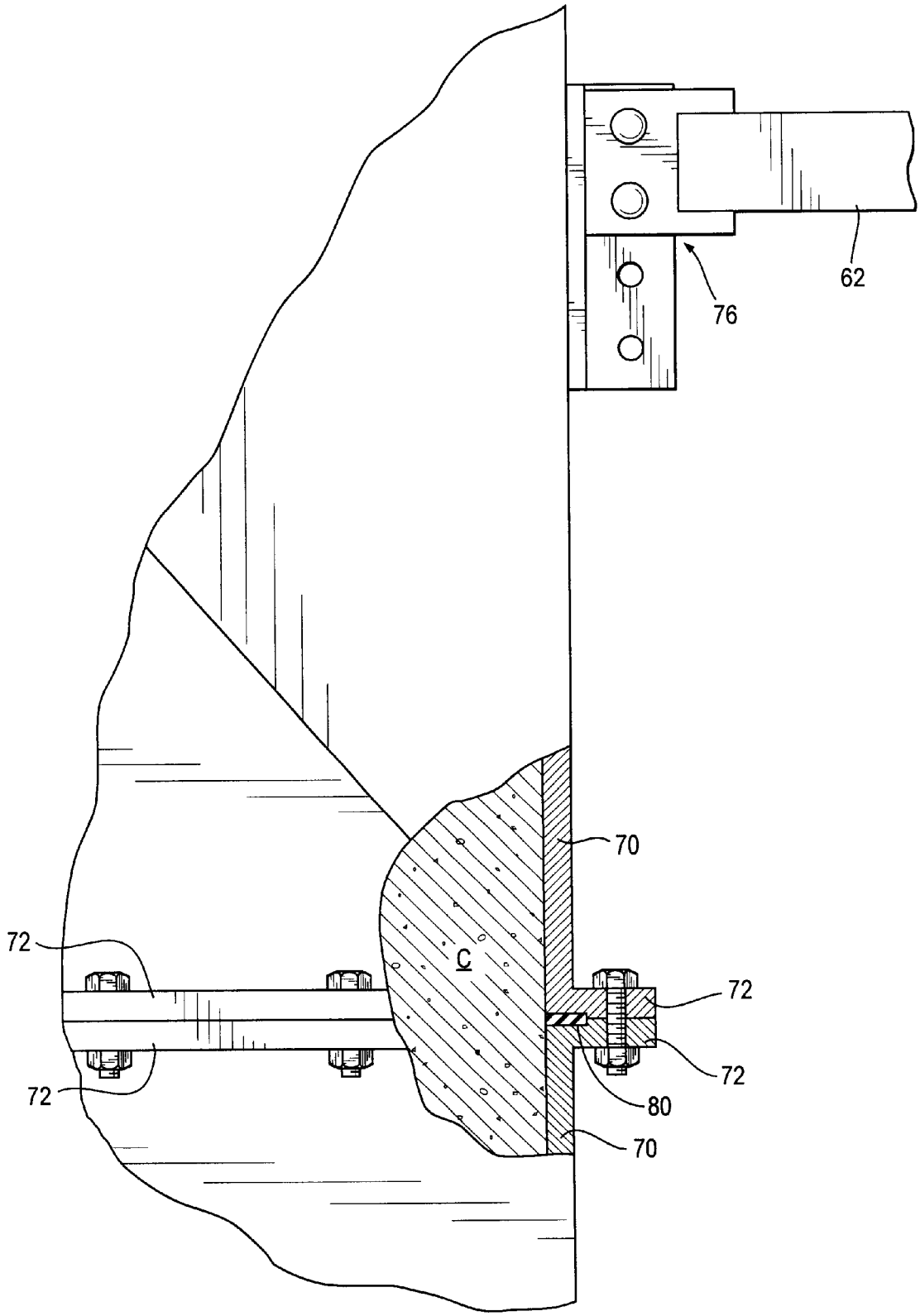
FIG. 4, on a larger scale compared to FIGS. 2 and 3, is a fragmentary detail of two tubular sections of a steel tube of one such tower, as filled with a cementitious material, and of other features of the same tower.

As illustrated in FIGS. 2, 3, and 4, each tower 20 comprises a trusswork including three upright steel tubes 60, in a triangular pattern wherein one such tube 60 is closer to the target T and wherein the other tubes 60 are farther from the target T, and including tubular horizontal and diagonal braces 62. At the lower end 22 of each tower 20, each tube 60 is anchored to a suitable foundation, which is not illustrated, in a manner conventional in tower construction. Each tube 60 is filled at least partially, preferably completely, with a cementitious material C, such as grout, which is pumped into said tube 60 and which is allowed to cure.

As illustrated in FIG. 4, each tube 60 comprises plural sections 70, which have end flanges 72 and which are bolted to one another at the flanges 72, via bolts and nuts, as used conventionally in tower construction. Fitments 76, which are used conventionally in tower construction, are used where the braces 62 are connected to the tube sections 70, one such fitment 76 being illustrated in FIG. 4. The flanges 72 contacted by the cementitious material C being pumped have gaskets 80, which are interposed between the flanges 72 contacted thereby, as means to prevent the cementitious material C being pumped from being extruded between the flanges 72 contacted by the cementitious material C before the cementitious material C has cured.

In a preferred embodiment, in which eighty towers 20 are employed, the endless array is circular, having an approximate diameter of 2504.87 feet (763.49 meters) measured at the centers of the towers 20 and having tower-to-tower spacings of approximately 98.42 feet (30.00 meters) measured at the centers of the towers 20. All stated dimensions are approximate or nominal.

In the preferred embodiment, in which each tower 20 is four hundred feet tall, the tubes 60 of each tower 20 have center-to-center spacings of 45 feet 2.5 inches (13.78 meters) at the lower end 22 of said tower 20. Further, each tube 60 is made of hot-dipped galvanized steel, having an outer diameter of 24 inches and having a wall thickness of 1.22 inches. Further, each brace 62 is made of hot-dipped galvanized steel, having an outer diameter of 6.63 inches and a wall thickness of 0.43 inch. All stated dimensions are approximate or nominal.

In the preferred embodiment, each tower 20 has 850,000 lbs. weight of steel, 550,000 lbs. weight of cementitious material, and 1,4000,000 lbs. weight of structure. All stated weights are approximate or nominal.

In the preferred embodiment, each guy 30, 40, is a zinc-coated, helical, steel wire, structural strand, which has a nominal diameter of two inches and which has a minimum breaking strength of 245 tons (490,000 lbs. ) and a modulus of 24,000 ksi (24,000,000 psi).

What is claimed is:

1. In a barrier intended to intercept a crashing airplane before the crashing airplane reaches a target and comprising an array of spaced towers, each of which is several hundred feet tall, an improvement wherein each tower comprises a trusswork including steel tubes, wherein each tube is filled at least partially with a cementitious material which is pumped into said tube and which is allowed to cure, wherein each tube comprises plural sections, which have end flanges and which are bolted to one another at the flanges, wherein the flanges contacted by the cementitious material being pumped have means to prevent the cementitious material from being extruded between the flanges contacted by the cementitious material before the cementitious material has cured, and wherein the means comprise gaskets between the flanges contacted by the cementitious material being pumped, and wherein the barrier further comprises a set of guys interconnecting each tower of the array with at least one other tower of the array, whereby forces imparted by an airplane crashing into a given tower of the array are distributed by guys of the first set to the at least one other tower interconnected with the given tower.

2. The improvement of claim 1 wherein the array is an endless array wherein guys interconnect each tower of the array with two other towers of the array, whereby forces imparted by an airplane crashing into a given tower of the array are distributed by guys of the first set to the other towers interconnected with the given tower.

3. In a barrier intended to intercept a crashing airplane before the crashing airplane reaches a target and comprising an array of spaced towers, each of which is several hundred feet tall, an improvement wherein each tower comprises a trusswork including steel tubes, wherein each tube is filled at least partially with a cementitious material, which is pumped into said tube and which is allowed to cure, wherein each tube comprises plural sections, which have end flanges and which are bolted to one another at the flanges, wherein the flanges contacted by the cementitious material being pumped have means to prevent the cementitious material from being extruded between the flanges contacted by the cementitious material before the cementitious material has cured, and wherein the means comprise gaskets between the flanges contacted by the cementitious material being pumped, wherein the barrier further comprises a first set of guys interconnecting each tower of the array with at least one other tower of the array, whereby forces imparted by an airplane crashing into a given tower of the array are distributed by guys of the first set to the at least one other tower interconnected with the given tower, and wherein the barrier further comprises a second set of guys extending away from the target, extending downwardly, and connecting the towers to ground anchors, whereby forces imparted by an airplane crashing into a given tower of the array are distributed by guys of the second set to the ground anchors connected to the given tower.

4. The improvement of claim 3 wherein the array is an endless array wherein guys interconnect each tower of the array with two other towers of the array, whereby forces imparted by an airplane crashing into a given tower of the array are distributed by guys of the first set to the other towers interconnected with the given tower.

5. In a barrier intended to intercept a crashing airplane before the crashing airplane reaches a target and comprising an array of spaced towers, each of which is several hundred feet tall, an improvement wherein each tower comprises a trusswork including steel tubes, wherein each tube is filled at least partially with a cementitious material, which is pumped into said tube and which is allowed to cure, wherein each tube comprises plural sections, which have end flanges and which are bolted to one another at the flanges, wherein the flanges contacted by the cementitious material being pumped have means to prevent the cementitious material from being extruded between the flanges contacted by the cementitious material before the cementitious material has cured, and wherein the means comprise gaskets between the flanges contacted by the cementitious material being pumped, and wherein the barrier further comprises a set of guys extending away from the target, extending downwardly, and connecting the towers to ground anchors, whereby forces imparted by an airplane crashing into a given tower of the array are distributed by guys of the second set to the ground anchors connected to the given tower.

6. The improvement of claim 5 wherein the array is an endless array wherein guys interconnect each tower of the array with two other towers of the array, whereby forces imparted by an airplane crashing into a given tower of the array are distributed by guys of the first set to the other towers interconnected with the given tower.

* * * * *